US005981892A

United States Patent [19]

Baird et al.

[11] Patent Number: 5,981,892

[45] Date of Patent: Nov. 9, 1999

[54] FOOD HANDLING CONVEYOR APPARATUS HAVING SOUND DETECTION MEANS

[75] Inventors: Randy K. Baird, Bolivar; Arthur L. Dean, Indiana; Kenneth M. Marshall, Indiana; Robert A. Krynock, Indiana; Stephen M. Pellegrino, Delmont; Steven R. Smith, Bolivar; Justin L. Emanuel, Saltsburg; David G. Pounds, Marion Center, all of Pa.

[73] Assignee: FMC Corporation, Chicago, Ill.

[21] Appl. No.: 08/761,418

[22] Filed: Dec. 6, 1996

[51] Int. Cl.[6] ..... B07C 5/00

[52] U.S. Cl. ..... 209/590; 209/656; 209/920

[58] Field of Search ..... 209/559, 576, 209/590, 656, 920

[56] References Cited

U.S. PATENT DOCUMENTS

| | | | |
|---|---|---|---|
| 2,208,202 | 7/1940 | Stanton et al. | 209/590 |
| 2,635,746 | 4/1953 | Gordon | 209/590 |
| 2,642,980 | 6/1953 | Soucek | 198/359 |
| 3,435,950 | 4/1969 | Suverkrop | 209/557 |
| 3,438,493 | 4/1969 | Goble | 209/590 |
| 3,559,805 | 2/1971 | Cragg | 209/599 |
| 3,659,710 | 5/1972 | Tice | 209/920 |
| 4,208,915 | 6/1980 | Edwards | 209/590 |
| 4,212,398 | 7/1980 | Parker et al. | 209/590 |
| 4,666,046 | 5/1987 | Manzer | 209/599 |
| 4,955,484 | 9/1990 | Rintala et al. | 209/590 |
| 5,037,536 | 8/1991 | Koch et al. | 209/325 |
| 5,135,114 | 8/1992 | Satake et al. | 209/920 |
| 5,335,293 | 8/1994 | Vannelli et al. | 382/17 |
| 5,526,119 | 6/1996 | Blit et al. | 356/402 |
| 5,526,437 | 6/1996 | West | 382/141 |
| 5,555,967 | 9/1996 | Hufford | 198/359 |

FOREIGN PATENT DOCUMENTS

| | | | |
|---|---|---|---|
| 212516 | 3/1987 | European Pat. Off. | 209/590 |
| 4402321 | 8/1995 | Germany . | |
| 63-80887 | 4/1988 | Japan | 209/920 |
| 4-346067 | 12/1992 | Japan . | |
| 266230 | 9/1968 | U.S.S.R. | 209/590 |
| 2222994 | 3/1990 | United Kingdom | 209/656 |

*Primary Examiner*—David A. Bucci
*Assistant Examiner*—Thuy V. Tran
*Attorney, Agent, or Firm*—Rockey, Milnamow & Katz, Ltd.

[57] ABSTRACT

A food handling conveyor apparatus includes a sound detection system for detecting the presence of a foreign object, such as a stone, among food product being conveyed. The apparatus includes a generally elongated vibratory conveyor bed along which food products are conveyed, with at least one discharge gate positioned at one end of the conveyor bed. An actuator is operatively connected to the discharge gate for effecting movement thereof between closed and open positions. A sound detection system of the apparatus, preferably including one or more directional microphones, is positioned in operative association with the conveyor bed and functions to differentiate between the sound of food product being conveyed, and the sound of a foreign object. The sound detection system is operatively connected with the actuator for the discharge gate, and effects opening of the discharge gate in timed relationship to detection of a foreign object so that the object is moved out of the food product stream.

18 Claims, 5 Drawing Sheets

FOOD HANDLING CONVEYOR APPARATUS HAVING SOUND DETECTION MEANS

TECHNICAL FIELD

The present invention relates generally to vibratory conveyor devices such as for conveying food products, and more particularly to a food-handling vibratory conveyor apparatus including a sound detection arrangement for detecting the presence of a foreign object, such as a stone or the like, among food product being conveyed.

BACKGROUND OF THE INVENTION

Vibratory conveying devices are widely used for handling of food products, such as vegetables, during processing. These types of devices typically include a generally elongated conveyor bed which is vibrated by an associated drive to effect conveyance of food products along the length of the bed.

During routine handling and processing of many food products, and in particular so-called root crop food products, stones or other objects may be present in the food product. Many handling systems typically utilize mechanical screening ("scalping") arrangements to eliminate stones or foreign matter from the food product during processing. However, while such mechanical screening normally works well for removal of stones or other objects which are of a size different from the food product being conveyed, such arrangements are ineffective for removal of stones or other objects which are similar in size and shape to the particular food product. In such circumstances, it has been necessary to resort to so-called water-floating arrangements for effecting separation of foreign objects, or to visual inspection of the food product. Of course, the removal of foreign objects from the food product is extremely important for the overall efficiency of the food processing operation, since stones or like objects usually damage food-processing equipment (i.e., cutters, shredders, knives, grids, sieves, etc.), thus resulting in undesirable processing down-time and equipment maintenance. Undesirable adulteration of the food product can also result if the foreign object is fragmented by processing equipment.

The present invention contemplates an automated arrangement for effecting separation of foreign objects from different food products, even if the foreign objects are sized and shaped similarly to the food product which is being processed.

SUMMARY OF THE INVENTION

A food handling conveyor apparatus embodying the principles of the present invention has been particularly configured for automated detection and separation of foreign objects, such as stones, from food product being conveyed by the apparatus. This detection and separation is effected by the provision of a sound detection system including one or more microphones positioned in operative association with a vibratory conveyor bed of the apparatus. The microphones are operatively connected with controls of the apparatus to divert the foreign object from the food product stream after the object has been detected.

In accordance with the illustrated embodiment, the present conveyor apparatus includes a generally elongated vibratory conveyor bed upon which food products are conveyed by vibration of the bed. In accordance with the illustrated embodiment, the conveyor bed includes at least one lane divider to thereby define a plurality of side-by-side lanes through which food product is conveyed.

The present apparatus further includes at least one discharge gate positioned at a discharge opening defined by the conveyor bed, which may be positioned at one end of the bed. In the illustrated embodiment, a plurality of discharge gates are each positioned in a respective one of a plurality of discharge openings at one end of the conveyor bed, with the discharge openings respectively associated with the plural lanes of the conveyor bed. Each discharge gate is movable between a closed position wherein food product is conveyed along the conveyor bed and over the gate, and an open position wherein food product is conveyed along the conveyor bed and moves by gravity through the discharge opening.

The present conveyor apparatus further includes at least one, and preferably a plurality of actuators each respectively operatively connected to one of the discharge gates for effecting movement thereof between the closed and open positions. In the illustrated embodiment, a plurality of air cylinders are provided in respective operative association with the discharge gates of the multi-lane conveyor bed.

In accordance with the present invention, a sound detection system is provided in operative association with the conveyor bed upstream of the one or more discharge gates of the conveyor apparatus. The sound detection system includes one or more microphones which are positioned for detecting sound from food product being conveyed along the conveyor bed. Notably, the sound detection system is configured to differentiate between the sound of food product being conveyed, and the sound of a foreign object, such as a stone. In this manner, the detection system provides a signal in response to detection of a foreign object for thereby effecting movement of the discharge gate to its open position so that the foreign object can move through the discharge opening of the conveyor bed.

In the illustrated embodiment, including a multi-lane conveyor bed, the sound detection system preferably includes a plurality of microphones positioned in respective association with the lanes of the conveyor bed for respective operation of the plural discharge gates. Thus, the presence of a foreign object in one of the lanes of the conveyor bed is detected, resulting in opening of the respective discharge gate, while conveyance of food product through the remaining lanes of the conveyor bed continues without interruption.

In the preferred embodiment, the conveyor bed is configured to include a audio chamber which desirably acts to amplify the difference in frequency and amplitude between a stone, or like foreign object, and the food product being conveyed. In one illustrated embodiment, the microphones of the sound detection system are positioned above the conveyor bed, with the audio chamber positioned generally therebeneath. In an alternate embodiment, microphones of the sound detection system are positioned in the audio chamber positioned beneath the surface of the bed upon which food product is conveyed. If desired, a portion of the conveyor bed at which the microphones are directed can be made from a material which differs from the remaining portion of the bed, thereby enhancing the difference in sound between the food product and any foreign object.

While the sound detection system of the present invention can be configured to include a single microphone for each lane of the conveyor bed, it is within the purview of the present invention to provide at least two microphones positioned in respective operative association with each lane of the conveyor bed. One of the microphones is positioned upstream of the other, with respect to the direction of movement of the food product along the conveyor bed, to thereby provide redundance in detection of any foreign object, thus minimizing erroneous signals and assuring validity of foreign object detection.

Other features and advantages of the present invention will become readily apparent from the following detailed description, the accompanying drawings, and the appended claims.

DETAILED DESCRIPTION

Figure 1:
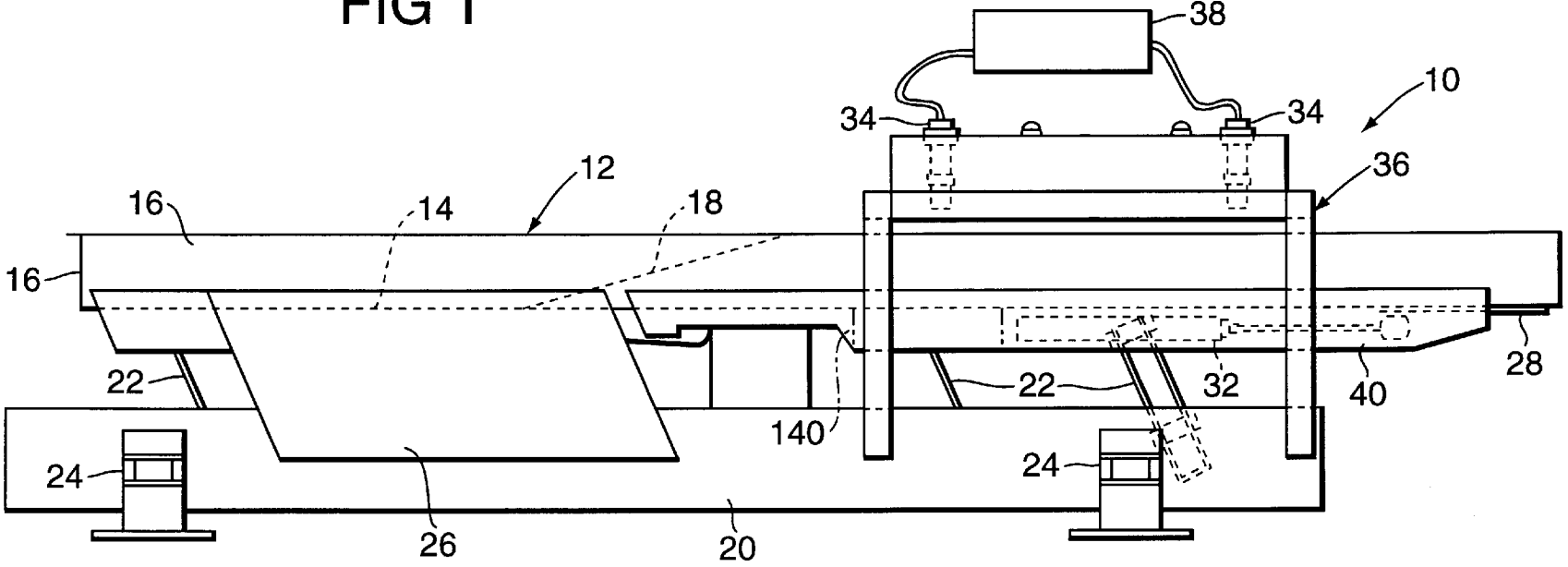
FIG. 1 is a diagrammatic, side elevational view of a food handling conveyor apparatus embodying the principles of the present invention.

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

Figure 2:
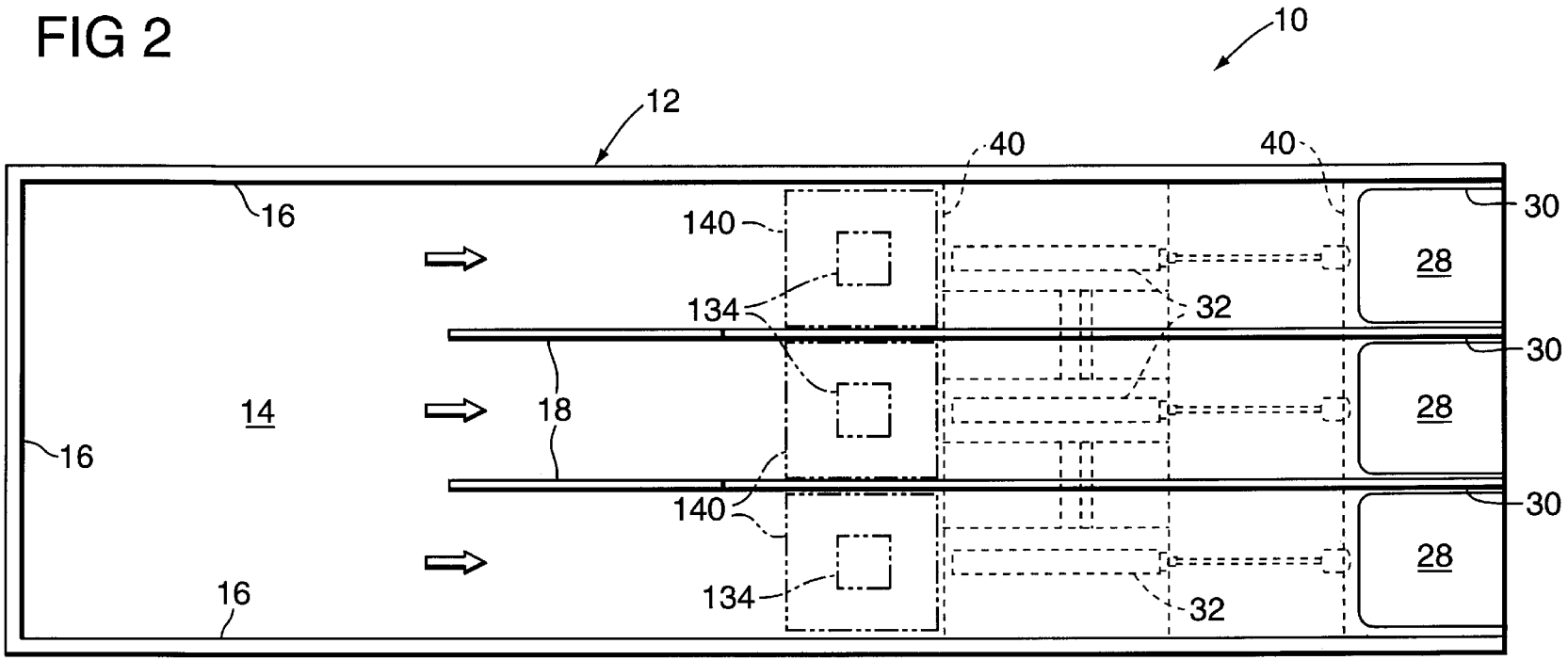
FIG. 2 is a diagrammatic top plan view of a vibratory conveyor bed of the food handling conveyor apparatus illustrated in FIG. 1.
Figure 3:
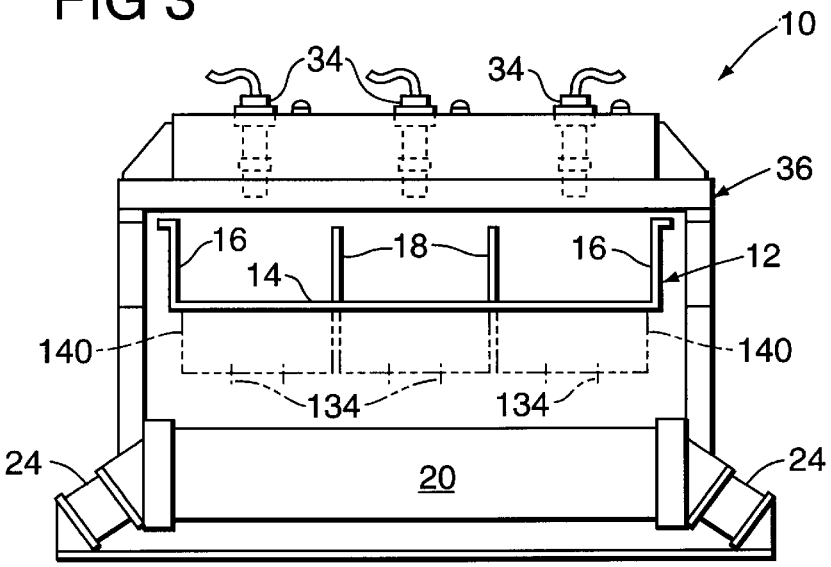
FIG. 3 is a diagrammatic end elevational view illustrating the food handling conveyor apparatus of FIG. 1.

With reference first to FIGS. 1 through 3, therein is illustrated a food handling conveyor apparatus 10 embodying the principles of the present invention. As will be further described, conveyor apparatus 10 includes a sound detection system which facilitates the sorting of stones, or other foreign objects, from food products during processing of the products for packaging, or other processing. Generally, the sound detection system utilizes one or more directional microphones to detect differences of frequencies and amplitudes within the audio range to differentiate between a stone being conveyed and the food product being conveyed. As will be described, an audio chamber is preferably provided to amplify the difference in frequency between a foreign object such as a stone, and food product, with sensitivity adjustment of the analog audio signal (S) allowing for differences in audio frequencies and amplitudes of various food products.

In the illustrated embodiment, food handling conveyor apparatus 10 has been configured to include multiple microphones, and multiple food product lane audio chambers, to allow adjustability to varying volume demands. The present system acts to detect a difference in frequency and amplitude sensed by a directional microphone of the sound detection apparatus, with an amplified analog system "thresholded" to create a signal that represents a stone, or normal product, present at the sensing field. If a stone is detected, the logic controls of the system activate a discharge gate downstream of the conveyor at a given distance to discharge the stone from the conveying system process. The discharge gate is held open for a sufficient time to assure that the stone (or other foreign object) is discharged, and then closes to continue processing of food product. As will be described, multiple sensing zone areas can be utilized based upon conveyor dimensions, and zones may be multiply sequenced to provide redundancy of signals to minimize erroneous signals, and assure validity of foreign object detection.

The conveyor apparatus 10 includes a generally elongated vibratory conveyor bed 12 upon which food products are conveyed by vibration of the conveyor bed. The conveyor bed includes a generally planar floor 14 and upstanding side walls 16 to provide the bed with a tray-like configuration. A plurality of upstanding lane dividers 18 (two in the illustrated embodiment) subdivide the product-conveying surface of the conveyor bed into a plurality of side-by-side lanes through which food product is conveyed.

The vibratory conveyor bed 12 is mounted on and is positioned above a generally elongated mounting frame 20 with respect to which the conveyor bed 12 vibrates. To this end, a plurality of leaf springs 22 join the conveyor bed 12 to the mounting frame 20, while accommodating vibratory movement of the conveyor bed with respect to the mounting frame. Isolation mounts 24, such as comprising suitable vibration-isolating rubber components, secure the mounting frame 20 to the floor or other mounting structure. A vibratory drive 26 (sometimes referred to as an exciter) is operatively connected to the vibratory conveyor bed 12, with operation of the vibratory drive thereby effecting vibratory motion of the conveyor bed for conveyance of food products thereal-ong in the direction indicated by the arrows shown in FIG. 2.

In order to effect separation of foreign objects, such as stones or the like, from food product being conveyed through the conveyor bed 12, the present apparatus includes at least one discharge gate 28 positioned in a respective discharge opening 30 defined by the conveyor bed 12 at one end thereof. In the illustrated embodiment, a plurality (3) of discharge gates 28 are positioned in respective association with a plurality of discharge openings 30, which in turn are provided in respective association with each of the lanes of conveyor bed 12 defined by lane dividers 18.

Each discharge gate 28 is movable between a closed position wherein food product is conveyed along the conveyor bed and over the discharge gate, and an open position wherein food product is conveyed along the conveyor bed and moves by gravity through the respective discharge opening. Movement of each discharge gate 28 in this fashion is effected by an actuator operatively connected to each gate, with the illustrated embodiment including a plurality of air cylinders 32 providing the necessary actuators for effecting individual movement of each discharge gate 28.

In accordance with the present invention, the conveyor apparatus 10 includes a sound detection system which operates to selectively open one or more of the discharge gates 28 in response to detection of a foreign object, such as a stone, within a respective one of the lanes of the conveyor bed 12. The sound detection system includes at least one microphone, preferably a directional microphone, positioned in operative association with each of the side-by-side lanes of the conveyor bed 12. Each of the microphones, designated 34, in the present sound detection system operates to detect the presence of a foreign object in the food product being conveyed, with the result being generation of a signal in response to detection of an object for effecting movement of the respective one of the discharge gates 28 from the closed position to the open position. The system operates to differentiate between the sound of the food product being conveyed, and the sound of food product containing a foreign object. In this embodiment, an isolation mount 36 is provided for spanning the conveyor bed 12, with the microphones 34 thus positioned above the conveyor bed, in respective association with the lanes defined thereby. Isolation mount 36 desirably isolates the microphones 34 from the vibration of the conveyor bed.

The microphones 34 are operatively connected with suitable programmable controls 38 of the sound detection system, which controls are in turn operatively connected with air cylinder actuators 32. Controls 38 can be suitably configured for signal conditioning and processing, thus permitting automated operation of the sound detection system.

In accordance with one illustrated embodiment of the present invention, a pair of microphones 34 are provided in operative association with each of the lanes of the conveyor bed 12, wherein one of the microphones is positioned upstream of the other microphone with respect to the direction of movement of food product along the conveyor bed. By this arrangement, the downstream one of the microphones functions to confirm any detection of a foreign object by the upstream one of the microphones. This arrangement of plural microphones arranged in series, for each lane of the conveyor bed, can be utilized for minimizing erroneous signals and assuring validity of detection signals.

In order to amplify the difference in frequency and amplitude between a stone and the food product being conveyed, the conveyor bed 12 of the present apparatus can be configured to include an audio chamber positioned beneath the surface of the bed upon which food product is conveyed. In the configuration of the present apparatus wherein one or more microphones 34 of the sound detection system are positioned above the conveyor bed on isolation mount 36, an audio chamber is formed beneath the conveying surface of the bed, generally beneath the isolation mount 36, by chamber portions 40. Air cylinders 32 can be positioned within the audio chamber 40.

An alternate embodiment of the present invention is illustrated in phantom line in FIGS. 1–3, wherein microphones of the sound detection system are positioned beneath the surface of conveyor bed 12 upon which food product is conveyed. In this alternate embodiment, an audio chamber 140 is positioned beneath the conveying surface of the bed 12, with a plurality of microphones 134 positioned in the audio chamber 140 in respective association with the lanes of the conveyor bed. The audio chamber 140 can be subdivided by suitable dividing members (see FIG. 3) which can be coated with a suitable dampening material to isolate the microphones 134 from each other.

With reference now to FIGS. 4 through 8, these figures represent data signals that are unconditioned directly from one of the directional microphones of the sound detection system of the present apparatus. As will be appreciated, further signal conditioning can be performed to further create differentiation between a stone and food product being handled.

Figure 4:
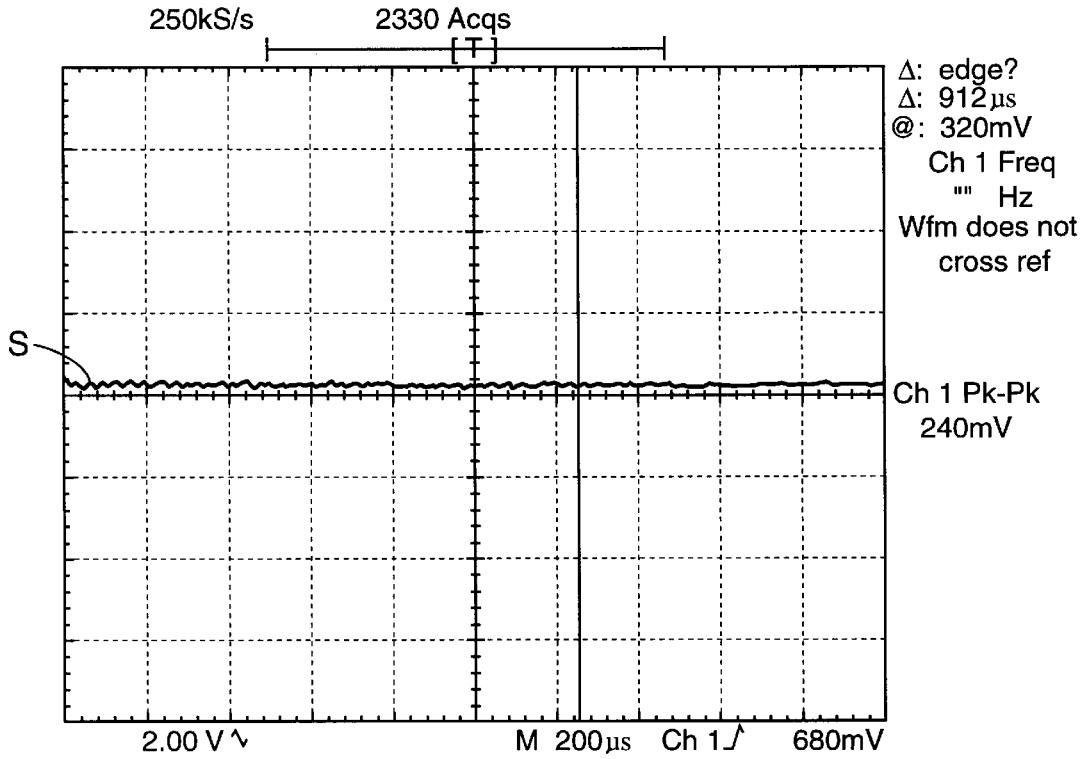
FIGS. 4 through 8 are illustrations of representative signals provided by a sound detection system of the present conveyor apparatus, which system is operable to differentiate between food product being conveyed, and a foreign object.
Figure 5:
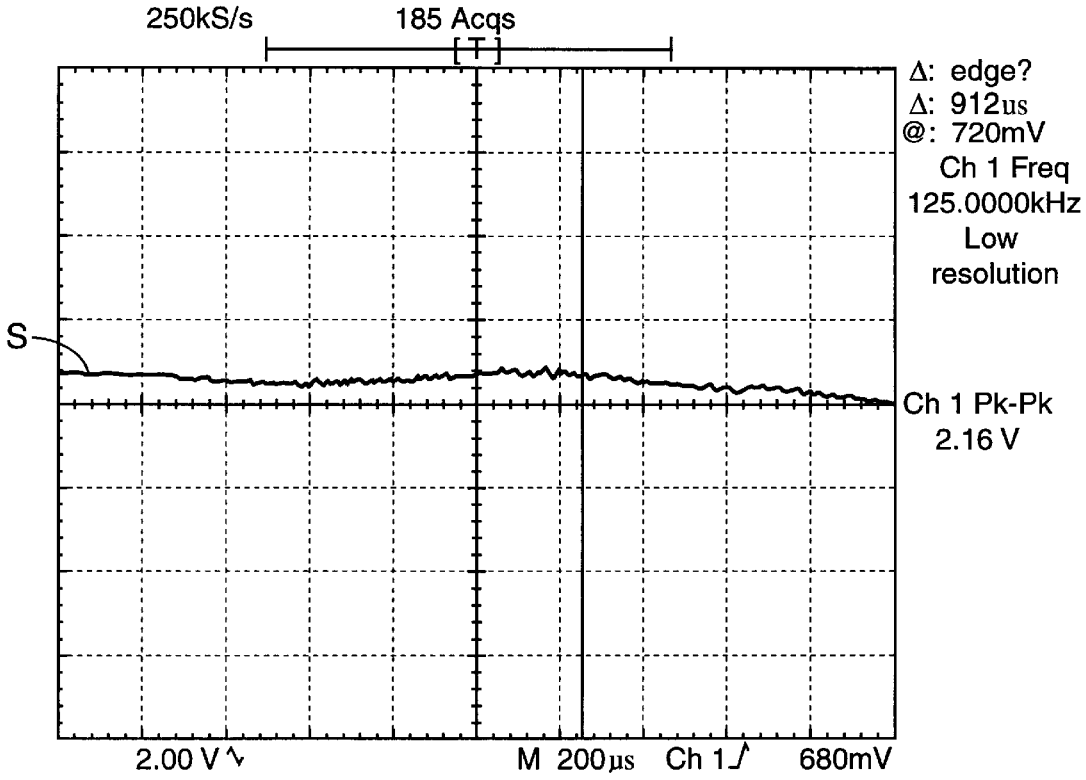

FIG. 4 is an illustration of a representative signal, designated S, from a directional microphone pointed at the vibratory conveyor bed during non-operation. This signal represents normal industrial background noise (signal equals 240 millivolts, peak to peak). FIG. 5 is an illustration of the signal from the directional microphone positioned as in FIG. 4, during normal conveyor operation with no food product being conveyed (signal equals 2.6 volts, peak-to-peak).

Figure 6:
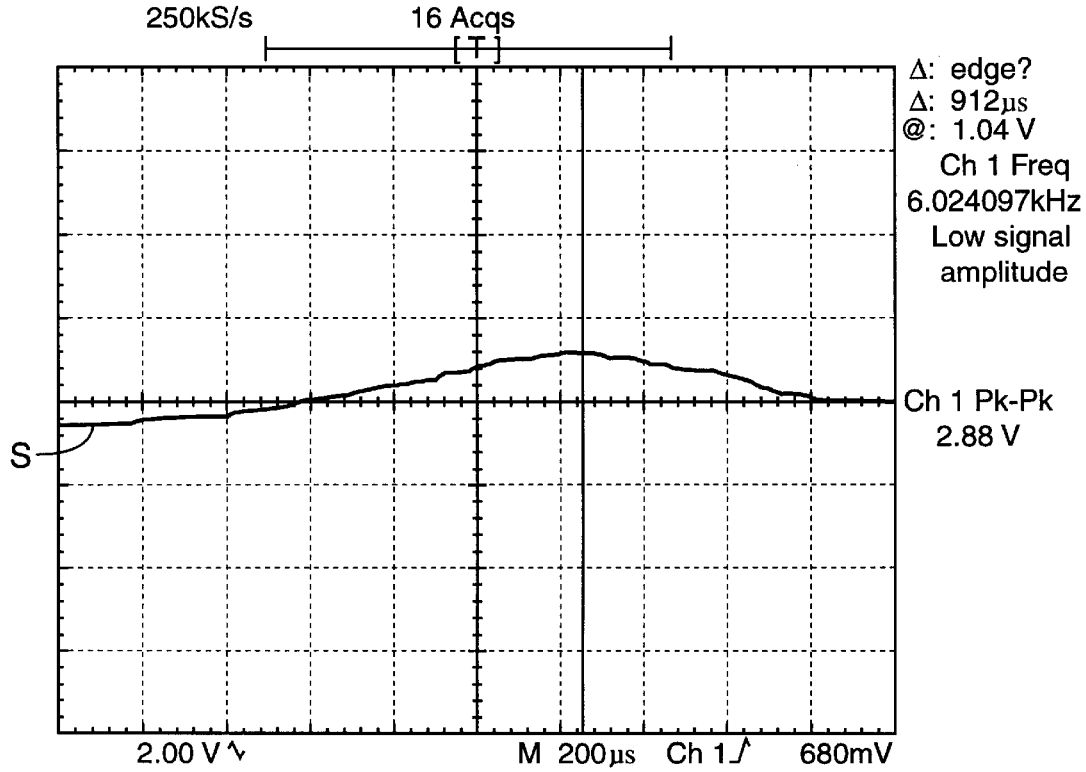

FIG. 6 is an illustration of the signal from the microphone with the conveyor in operation transferring potatoes on the conveyor bed in a single layer mode (signal equals 2.88 volts, peak-to-peak).

Figure 7:
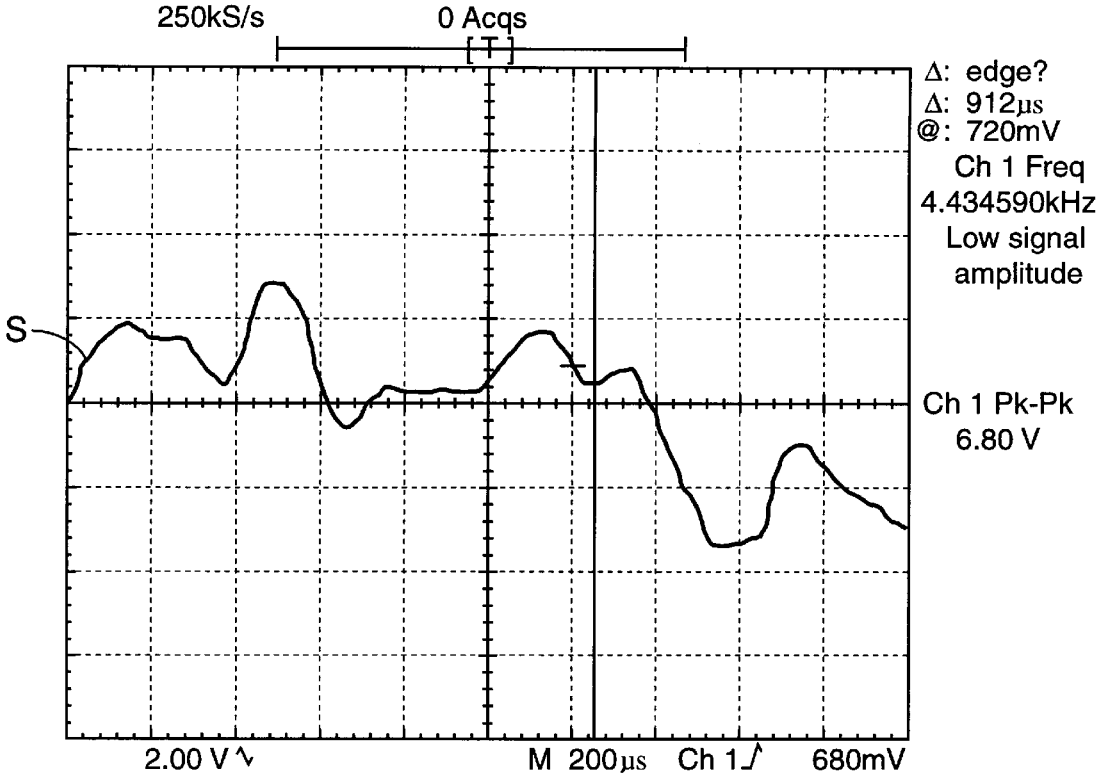

FIG. 7 is an illustration of the signal from the microphone with the conveyor in operation transferring a single stone, approximately one-fourth the size as a nominal potato (signal equals 6.80 volts, peak-to-peak).

Figure 8:
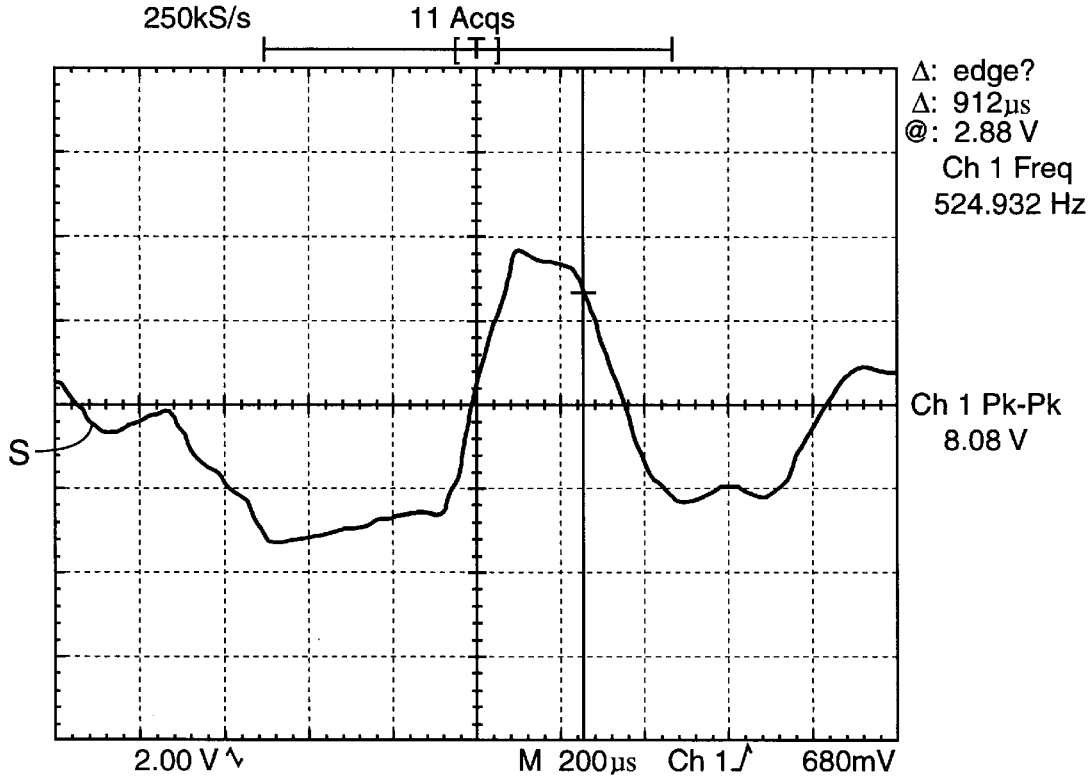

FIG. 8 is an illustration of the signal from the microphone with the conveyor in operation transferring a single stone the same size as a nominal potato (signal equals 8.08 volts, peak-to-peak).

As will be recognized from the graphical illustrations of microphone signals shown in FIGS. 4–8, the present sound detection system can be operated, via controls 38, to process the signals received from the one or more microphones 34 (or 134) of the system, with the controls processing the signals to effect operation of the appropriate one of air cylinders 32, for opening of the respective discharge gate 28, as may be required. Operation of the discharge gate can be coordinated and sequenced with detection of a foreign object to minimize the amount of food product which passes through the respective discharge opening 30, together with the foreign object, when the respective gate is in its open position. Subsequent movement of the opened gate to its closed position reestablishes normal flow of food product along the conveyor bed to associated processing and packaging equipment.

As will be appreciated from the nature of the signals provided by the one or more microphones of the sound detection system of the present invention, different types of signal processing can be performed to achieve the desired separation of foreign objects from the food product stream. For example, it is within the purview of the present invention to assign different signal "signatures" to different types and sizes of foreign objects, and through appropriate signal analysis (such as "template matching"), operate the controls 38 of the detection system to identify different types of foreign objects. Of course, the system can be configured for use with different sized food products, such as potatoes, turnips, etc. Additionally, it will be recognized that the system can be modified to effect grading or classification of food products, apart from its detection of foreign objects. It is also within the purview of the present invention to configure the region at which the one or more microphones of the system are positioned out of different materials from surrounding portions of the conveying structure. For example, a conveyor bed of phenolic resin can be provided, with a region at the microphones manufactured from metallic material, thereby further enhancing the difference in sound created by a foreign object being handled by the conveyor apparatus.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. A food handling conveyor apparatus comprising:

an elongated vibratory conveyor bed upon which food products are conveyed by vibration of said conveyor bed;

at least one discharge gate positioned at a discharge opening defined by said conveyor bed, said gate being movable between a closed position wherein food product is conveyed along said conveyor bed and over said gate, and an open position wherein food product is conveyed along said conveyor bed and moves through said discharge opening;

an actuator operatively connected to each said discharge gate for effecting movement thereof between said closed and open positions; and sound detection means operatively associated with said conveyor bed upstream of said discharge gate for detecting sound from food product conveyed therealong, said sound detection means being configured to differentiate between the sound of food product being conveyed, and the sound of a foreign object, whereby said detection means provides a signal in response to detecting a foreign object for effecting movement of said discharge gate to said open position so that the foreign object can move through said discharge opening.

2. A food handling conveyor apparatus in accordance with claim 1, wherein:

said conveyor bed includes at least one lane divider to thereby define a plurality of side-by-side lanes through which food product is conveyed, said apparatus including a plurality of said discharge gates each positioned in a respective discharge opening respectively associated with each of said lanes, said sound detection means comprising a plurality of microphones positioned in respective association with said lanes for respective operation of said discharge gates.

3. A food handling conveyor apparatus in accordance with claim 1, wherein said vibratory conveyor bed includes an audio chamber positioned beneath a surface of the bed upon which food product is conveyed, said sound detection means being positioned in operative association with said audio chamber.

4. A food handling conveyor apparatus in accordance with claim 1, wherein said sound detection means comprises at least one microphone positioned above said conveyor bed for detecting the sound of food product being conveyed therein.

5. A food handling conveyor apparatus in accordance with claim 4, including isolation mounting means for mounting said microphone above said conveyor bed while isolating said microphone from the vibration of said conveyor bed.

6. A food handling conveyor apparatus in accordance with claim 1, wherein said sound detection means includes at least two microphones, one of which is positioned upstream of the other with respect to a direction of movement of food product along said conveyor bed, said downstream one of said microphones functioning to confirm any detection of a foreign object by the upstream one of said microphones.

7. A food handling conveyor apparatus comprising:

an elongated vibratory conveyor bed upon which food products are conveyed by vibration of said conveyor bed, said conveyor including at least one lane divider to thereby define a plurality of side-by-side lanes through which food product is conveyed;

a plurality of discharge gates each positioned in a respective one of a plurality of discharge openings defined by said conveyor bed, each said discharge gate being movable between a closed position wherein food product is conveyed along the respective lane of the conveyor bed and over the discharge gate, and an open position wherein said food product is conveyed along the respective lane of the conveyor bed and moves by gravity through the respective discharge opening;

a plurality of actuators respectively operatively connected to each said discharge gate for effecting movement of each gate between said closed and open positions; and sound detection means comprising at least one microphone positioned in respective operative association with each said lane of said conveyor bed for detecting the presence of a foreign object, and for providing a signal in response thereto to effect movement of the respective one of said discharge gates from said closed position to said open position.

8. A food handling conveyor apparatus in accordance with claim 7, wherein said vibratory conveyor bed includes an audio chamber positioned beneath the surface of the bed upon which food product is conveyed, said sound detection means comprising a plurality of said microphones positioned in said audio chamber.

9. A food handling conveyor apparatus in accordance with claim 7, including isolation mounting means spanning said vibratory conveyor bed for mounting said microphones of said sound detection means above said conveyor bed while isolating said microphones from the vibration of said conveyor bed.

10. A food handling conveyor apparatus in accordance with claim 9, wherein said conveyor bed includes an audio chamber positioned beneath a surface along which food product is conveyed, and generally beneath said isolation mounting means.

11. A food handling conveyor apparatus in accordance with claim 9, wherein said sound detection means comprises at least two microphones positioned in respective operative association with each said lane of said conveyor bed on said isolation mounting means, one of said microphones being positioned upstream of the other with respect to a direction of movement of food product along said conveyor bed to provide redundancy in detection of any foreign object.

12. A food handling conveyor apparatus in accordance with claim 7, wherein said sound detection means includes means for identifying different foreign objects by signature analysis of signals from said at least one microphone.

13. A food handling conveyor apparatus, comprising:

an elongated vibratory conveyor bed upon which food products are conveyed by vibration of said conveyor bed;

at least one discharge gate positioned at a discharge opening defined by said conveyor bed, said gate being movable between a closed position wherein food product is conveyed along said conveyor bed and over said gate, and an open position wherein food product is conveyed along said conveyor bed and moves through said discharge opening;

an actuator operatively connected to said discharge gate for effecting movement thereof between said closed and open positions;

a sound detector located upstream of said discharge gate and arranged to receive sound from said conveyor bed, whereby said sound detector provides a signal in response to detecting a foreign object; and a controller which is signal-connected to said sound detector for receiving said signal, and said controller is signal-connected to said actuator for effecting movement of said discharge gate to said open position so that the foreign object detected by said sound detector can move through said discharge opening.

14. A food handling conveyor apparatus in accordance with claim 13, wherein said conveyor bed includes at least one lane divider to thereby define a plurality of side-by-side lanes through which food product is conveyed, and said apparatus includes a plurality of discharge gates, each discharge gate positioned in a respective discharge opening respectively associated with each of said lanes; and said apparatus includes a plurality of actuators each operatively connected to one of said discharge gates and a plurality of sound detectors each positioned in a respective lane and each signal-connected to said controller, said controller signal-connected to said plurality of said actuators.

15. A food handling conveyor apparatus in accordance with claim 13, wherein said vibratory conveyor includes an audio chamber positioned beneath a surface of said bed upon which food product is conveyed, said sound detector being positioned in operative association with said audio chamber.

16. A food handling conveyor apparatus in accordance with claim 13, wherein said sound detector comprises a microphone positioned above said conveyor bed for detecting the sound of food product being conveyed therein.

17. A food handling conveyor apparatus in accordance with claim 16, including isolation mounting means for mounting said microphone above said conveyor bed while isolating said microphone from the vibration of said conveyor bed.

18. A food handling conveyor apparatus in accordance with claim 13, wherein said sound detector includes at least two microphones, one of which is positioned upstream of the other with respect to a direction of movement of food product along said conveyor bed, said downstream one of said microphones functioning to confirm any detection of a foreign object by the upstream one of said microphones.

* * * * *